US006502361B1

(12) United States Patent
Hills, Sr.

(10) Patent No.: US 6,502,361 B1
(45) Date of Patent: Jan. 7, 2003

(54) ROD CHAIRS

(76) Inventor: Robert A. Hills, Sr., 4176 Chelsea Harbor West, Jacksonville, FL (US) 32224

( * ) Notice: Subject to any disclaimer, the term of this patent is extended or adjusted under 35 U.S.C. 154(b) by 0 days.

(21) Appl. No.: 09/918,236

(22) Filed: Jul. 30, 2001

(51) Int. Cl.[7] ..... E04C 5/16

(52) U.S. Cl. ..... 52/677; 52/684; 52/687; 52/678; 52/679

(58) Field of Search ..... 52/677, 684, 689, 52/678

(56) References Cited

U.S. PATENT DOCUMENTS

| | | | | | |
|---|---|---|---|---|---|
| 1,043,199 | A | * | 11/1912 | Burk | 52/684 |
| 1,245,632 | A | * | 11/1917 | Straub | 182/182.1 |
| 1,361,162 | A | * | 12/1920 | Lampert | 52/684 |
| 1,421,807 | A | * | 7/1922 | Metzger | 52/684 |
| 1,517,102 | A | * | 11/1924 | Bricker | 52/684 |
| 1,882,499 | A | * | 10/1932 | Johns | 52/454 |
| 2,271,592 | A | * | 2/1942 | Hilpert | 52/334 |
| 2,730,211 | A | * | 1/1956 | Findlay | 52/677 |
| 3,899,857 | A | * | 8/1975 | Mochizuki | 52/126.6 |
| 5,408,799 | A | * | 4/1995 | Ron et al. | 52/677 |

* cited by examiner

*Primary Examiner*—Carl D. Friedman
*Assistant Examiner*—Basil Katcheves
(74) *Attorney, Agent, or Firm*—Arthur G. Yeager

(57) ABSTRACT

Rod chairs for use in concrete form for positioning reinforcement rods prior to filling with concrete includes a flat rectangular metal blank for folding into a rod chair that includes an elongated planar portion having a pair of spaced portions to be bent to form a pair of generally curved end walls and a pair of horizontal parallel sides to be bent downwardly to form a pair of generally horizontal flanges, and having at least one three sided cut-out to form at least one elongated finger integrally with the planar portion to be bent upwardly to form a hook for holding a reinforcement rod therebeneath, a pair of recess cut-out apertures positioned at free ends of the planar portion, and elongated cuts intersecting the respective recess cut-out apertures and extend generally along the longitudinal axis to the respective free ends of the metal blank to be bifurcated and separated angularly from the recess cut-out apertures to the free ends to form a pair of leg portions wherein each leg portion to be bent to form a pair of perpendicular faces that terminate with a foot disposed on ground to support the rod chair. In another embodiment of the present invention, a plurality of hooks is employed for holding reinforcement rods therebeneath.

23 Claims, 4 Drawing Sheets

10°±
21
34
41
45
38
42
46
26
58
29
23
6
6
23

18
23
5°±

48
45
46

36
38
30

58
26
29
25
10°±
27
21
38
42
34
41
45

ROD CHAIRS

CROSS REFERENCE TO RELATED APPLICATIONS

Not Applicable

FEDERALLY SPONSORED RESEARCH

Not Applicable

BACKGROUND OF THE INVENTION

1. Field of the Invention

The present invention relates to the field of locating and placing reinforcement bars in the concrete structures, and more particularly to the rod chair devices and the manufacture thereof 2. Related Art Reinforcing concrete structures by reinforcement steel bars is a well-known art in the construction industry. It is common knowledge that reinforcement bars are more easily placed in engineered appropriate locations in the forms for pouring concrete by the use of the common wire rod chairs with reinforcement rods attached to the chairs by tie wires or the like. These rod chairs are difficult to manufacture, require some spot welding, which often breaks, and the machinery to manufacture same are expensive and require substantial maintenance and are prone to extended downtime. A less expensive rod chair that is fabricated from sheet metal with a minimum of waste, is of minimum weight and is stackable and less costly to package and ship and does not require tying the reinforcement rod to the chair is needed to overcome the deficiencies of the prior art.

BRIEF SUMMARY OF THE INVENTION

The present invention is related to improved rod chairs for positioning and supporting reinforcement rods in concrete structures. The rod chair includes an elongated body having a longitudinal axis and a transverse axis, and a planar portion that includes a pair of spaced generally curved end walls and a pair of generally horizontal parallel flanges extending downwardly from the planar portion. The elongated body includes at least one finger formed integrally from the planar portion and extends upwardly above the plane of the planar portion for holding a reinforcement rod therebeneath. The finger forms a hook that has a curved body portion for sandwiching the reinforcement rod between the planar portion and the inner surface of the curve body of the hook. The hook preferably includes a rib formed in the inner surface to rigidify the hook and to enhance the holding of the reinforcement rod.

The planar portion includes at least one slot from which at least one finger is cut out. The slot has three free sides and the at least one finger forms a fourth side of the slot, the slot has a width slightly larger than the width of the finger to permit stacking of the rod chair onto an identical rod chair.

The elongated body terminates with a pair of elongated and spaced stabilizing leg portions respectively integral with the end walls to support the planar portion spatially above the ground. Each stabilizing leg portion includes a recess cut-out, which has a lip that extends inwardly, disposed between a pair of spaced oppositely disposed legs to permit bifurcation and separation angularly of the stabilizing leg portion into two legs. Each one of the legs has a pair of planar faces perpendicular with each other and one elongated foot integral with at least one of the planar faces and each foot extends transversely of the longitudinal axis to support the planar portion and the reinforcement rod, which is carried by the rod chair. The elongated foot has a lower surface disposed on the ground and an elongated rib that extends upwardly from the lower surface.

The elongated body preferably includes a plurality of fingers to support as many reinforcement bars as desired. The body may also include a pair of spaced indexing apertures positioned spacedly from the central transverse axis of the body for manufacturing guides.

BRIEF DESCRIPTION OF THE DRAWINGS

The novel features believed to be characteristic of this invention are set forth with particularity in the appended claims. The invention itself, however, both as to its organization and method of operation, together with further objects and advantages thereof, may best be understood by references to the following description taken in connection with the accompanying drawings in which:

DETAILED DESCRIPTION OF THE INVENTION

The invention relates to fixtures employed in forming reinforced concrete structural shapes, such as slabs, floors and footings for a building. Many concrete structures are prepared by pouring concrete into forms and allowing the concrete to solidify and cure before removing the forms to open the structure to the atmosphere. Concrete structures usually include reinforcement rods, bars or wires in order to strengthen the structure against destructive forces and support the structure to withstand great loads.

The prior art employs different metal chairs to support reinforcement rods and prevent their displacement due to the forces of the liquid concrete as it poured into the forms or due to the weight of the rods. However, those rods are not satisfactory because they often collapse under the weight of the rods and they demand significant time and resources in order to make them.

The present invention is an improved rod chair for holding the reinforcement bar where they are intended to be. The rod chair in accord with the present invention is made of flat rectangular metal blank folded into rectangular rod chair having elongated body that includes a planar portion having at least one hook to hold a reinforcement rod tightly therein and terminates with two leg portions with two outwardly extending feet to support the planar portion and the reinforcement rods.

Figure 1:
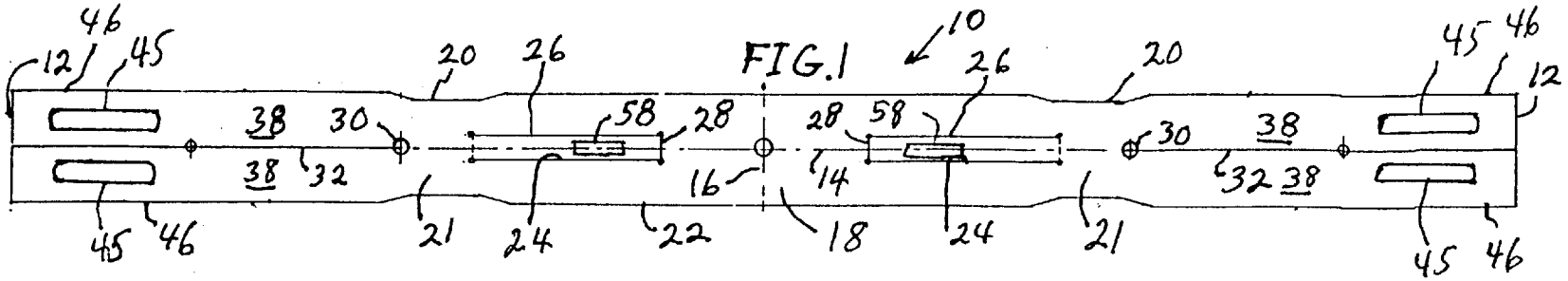
FIG. 1 is a top plan of a rectangular metal blank to be folded into a rod chair in accord with one embodiment of the present invention.

FIG. 1 shows the flat rectangular metal blank 10 of selected thickness including a planar portion 18 having a longitudinal axis 14 and a transverse axis 16 and free ends 12. The planar portion 18 terminates with a pair of portions 20 spaced from respective free ends 12 to be bent to form a pair of generally curved end walls 21, best shown in FIG. 2. The planar portion 18 further includes a pair of horizontal parallel sides 22 to be bent to form a pair of flanges 23, best shown in FIGS. 4 and 6, and preferably a pair of three sided cut-outs 24 forming a pair of elongated fingers 26 integrally with free end 28 of the three sided cut-outs 24. The pair of fingers 26 is bent upwardly to form a pair of hooks 27, best shown in FIG. 4, for holding a reinforcement rod 25. The planar portion 18 further includes a pair of recess cut-out apertures 30 positioned remotely from the free ends of the planar portion 12 and elongated cuts 32 along the longitudinal axis 14 intersecting the recess cut-out apertures 30 and extending generally along the longitudinal axis 14 to the free ends 12 of the metal blank 10 to form a pair of stabilizing leg portions 34 to support the rod chair 11 bent and formed from the metal blank 10. The recess cutout apertures 30 includes a lip 36 extending inwardly, best shown in FIG. 2, wherein the recess cut-out apertures 30 are positioned generally medially of the leg portions 34 to permit bifurcation and angular separation of the leg portions 34 into a pair of legs 38, best shown in FIG. 2.

Figure 2:
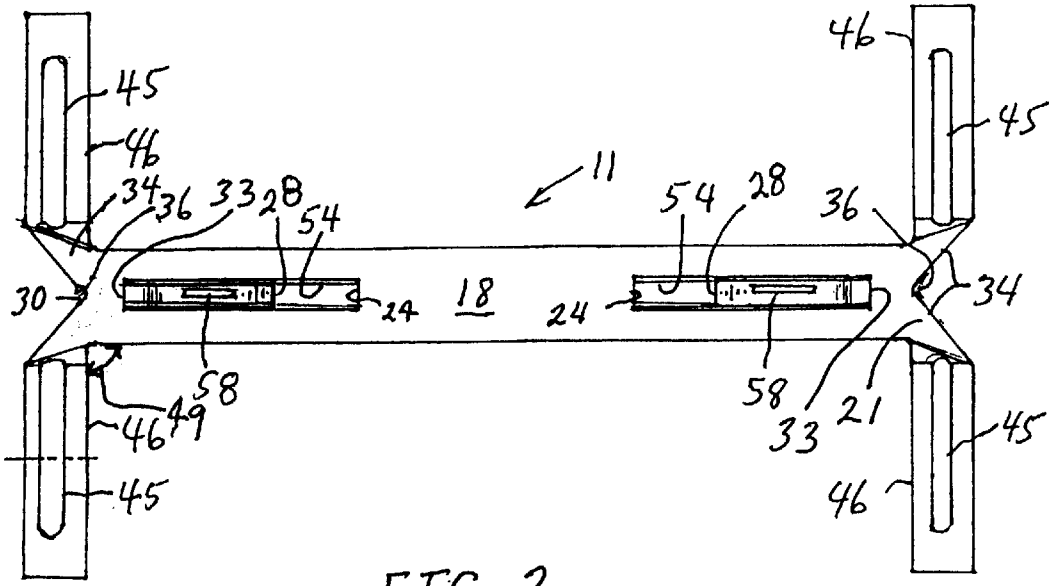
FIG. 2 is a top view of a rod chair fabricated from the blank of FIG. 1.

FIG. 2 shows the rod chair 11 in accord with the present invention as having planar portion 18 spatially positioned above ground and having a pair of three sided cut outs 24 at opposite ends of the planar portion 18. Each of the edges is deformed downwardly to enlarge the slots 54 from the three sided cut-outs 24 and the finger 26 has a hook 27 formed integrally with the fourth side 33. The finger 26 includes a rib 58 to add structural strength thereto so that when bent around the reinforcement rod 25, it is gripped tightly.

Figures 4, 5, 6, 7:
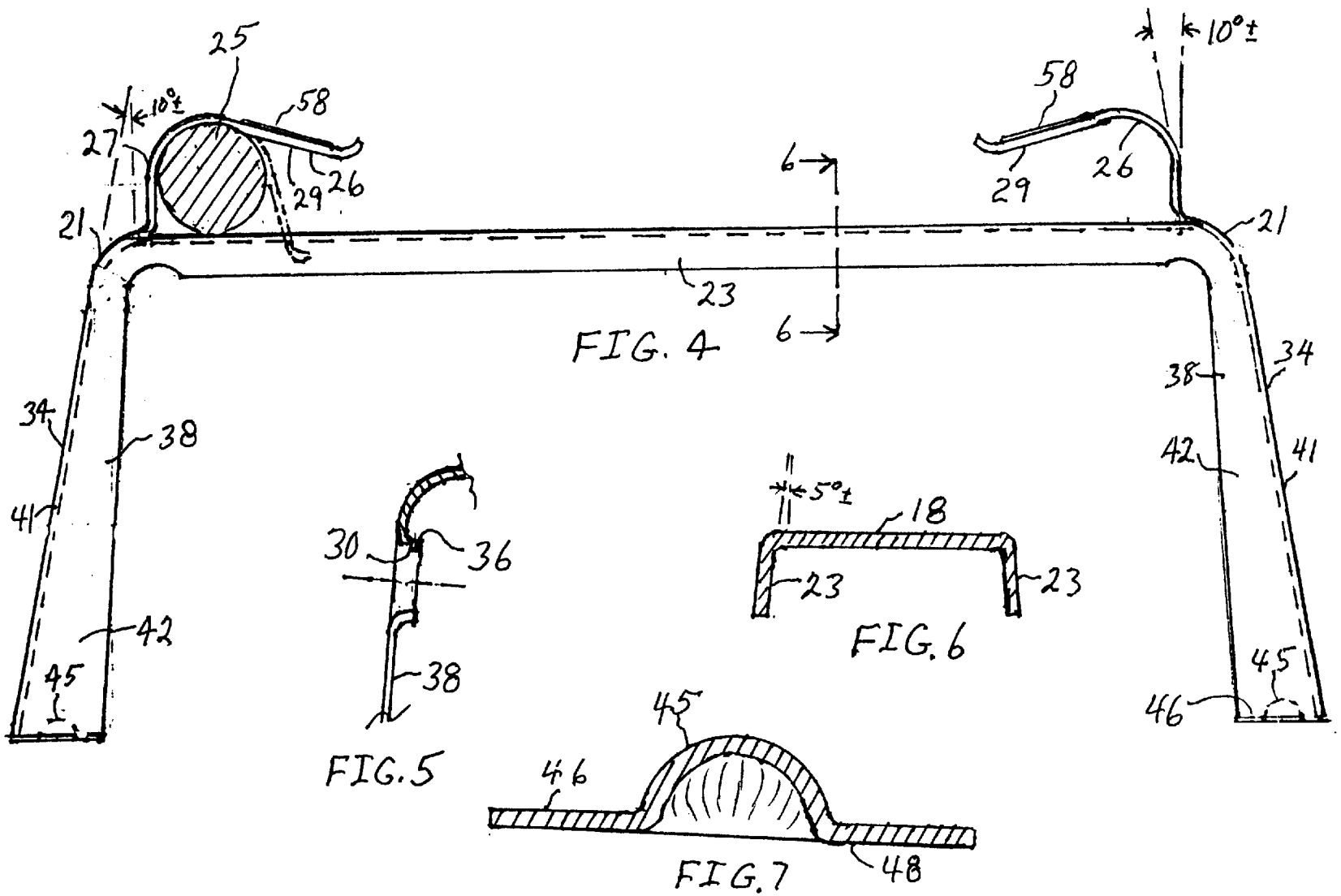
FIG. 4 is a side elevational view of FIG. 2.
FIG. 5 is a cross sectional view taken along line 5—5 of FIG. 3.
FIG. 6 is a cross sectional view taken along line 6—6 of FIG. 4.
FIG. 7 is a cross sectional view taken along line 7—7 of FIG. 3.

The planar portion 18 has a pair of curved end walls to support the weight of the rod chair 11 and the reinforcement rod 25, best shown in FIG. 4. The curved end walls 21 are adjacent a rounded recessed cut-out aperture 30, which permits angular separation of each leg portion 34 into two legs 38. Each leg 38 is bent and formed into two planar faces 41 and 42, each face being generally perpendicular to the other face. One face 42 is formed generally continuous with the horizontal flanges 23, and the other face 41 being transverse to the longitudinal axis 14. A foot 46 is formed integrally with one of the faces, herein faces 41 and 42 and extends transversely of the longitudinal axis 14 and includes a stiffening rib 45 to rigidify the foot 46 to enhance the support for the rod chair 11 and the reinforcement rod 25. The angle 49 between the foot 46 and the longitudinal axis 14 of the rod chair 11 is between 90°–110° degree and preferably 90°.

Figure 3:
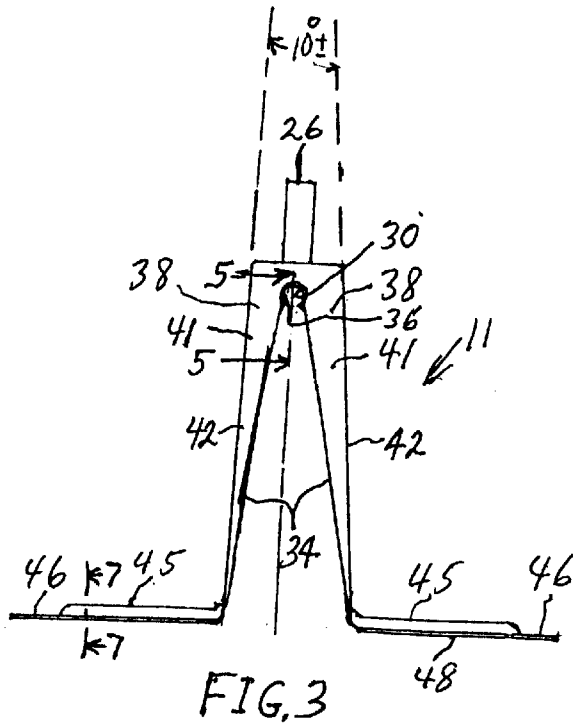
FIG. 3 is an end elevational view of the rod chair of FIG. 2.

FIG. 3 shows an end elevational view of the rod chair 11 illustrating the details of the leg portions 34 including a pair leg 38 that respectively terminate with feet 46. A cross sectional view taken along line 7—7 in FIG. 3 shows the upwardly extending reinforcement rib 45 formed in the lower surface 48 of foot 46 in FIG. 7 as being elongated semi-cylindrical rib disposed midway of foot 46.

The section taken along line 5—5 of FIG. 2 through the rounded recess cut-out apertures 30 is shown in FIG. 5 as having a lip 36 bent inwardly and positioned adjacent the curved end walls 21 to reduce the occurrence of cracking of the metal during separation of the legs 38 from the blank 10 to their positions shown in FIG. 3.

FIG. 4 is a side elevational view of the rod chair 11 showing a pair of fingers 26 formed into hooks 27 integrally with the planar portion 18 preferably adjacent the curved end walls 21, for holding reinforcement rod 25 therebeneath. Each hook 27 may include a stiffening rib 58 to rigidify the hook 27 to grip the reinforcement rod 25 tightly. A rod chair with more than one hook 27 can be used depending on the engineering requirements for the specific building project.

Figure 9:
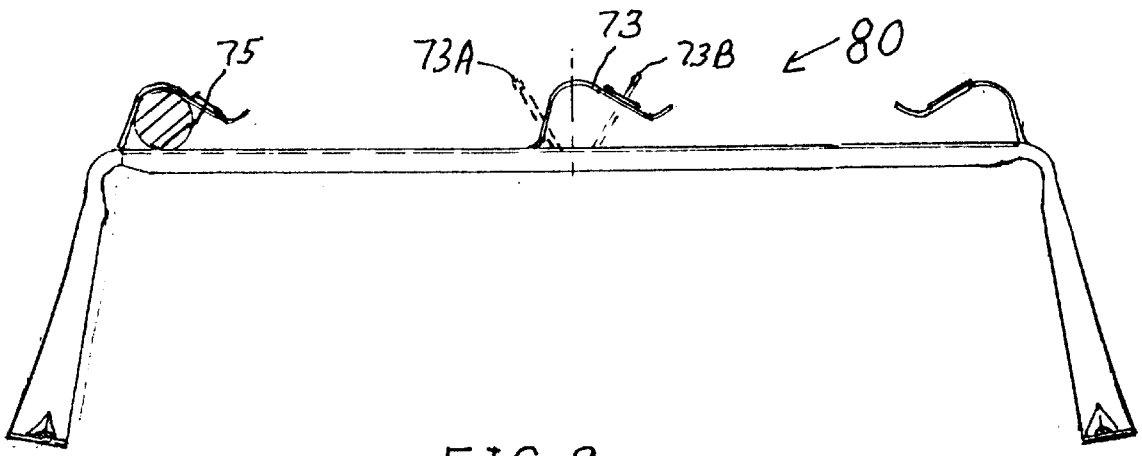
FIG. 9 is a side elevational view of the fabricated rod chair of the metal blank of FIG. 8.
Figure 8:
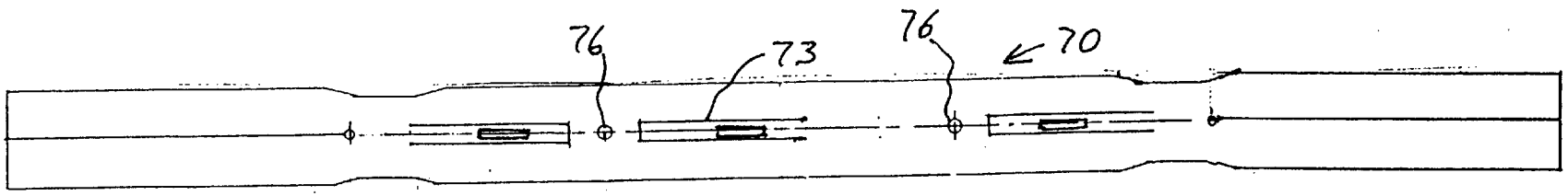
FIG. 8 is a flat top plan view of a rectangular metal blank in accord with another embodiment of the rod chair of the present invention.

FIG. 8 depicts another embodiment of the present invention in which blank 70 includes three spaced elongated fingers 72 formed integrally from a planar portion 71. The above descriptions of FIGS. 1–7 are applicable to FIGS. 8 and 9, with the added features of a longer blank to accommodate an additional hook 73 to hold another reinforcement rod, like the rod 75, and the pair of indexing apertures 76 for manufacturing guide. Also, indexing apertures may be included in the first embodiment depicted in FIGS. 1–7. Furthermore, as shown in FIG. 9, the finger 73 alternatively may be a pair of angularly spaced smaller fingers 73A and 73B extending away from each other, which are bent around a rod thereafter to hold a reinforcement rod therebetween.

Figure 10:
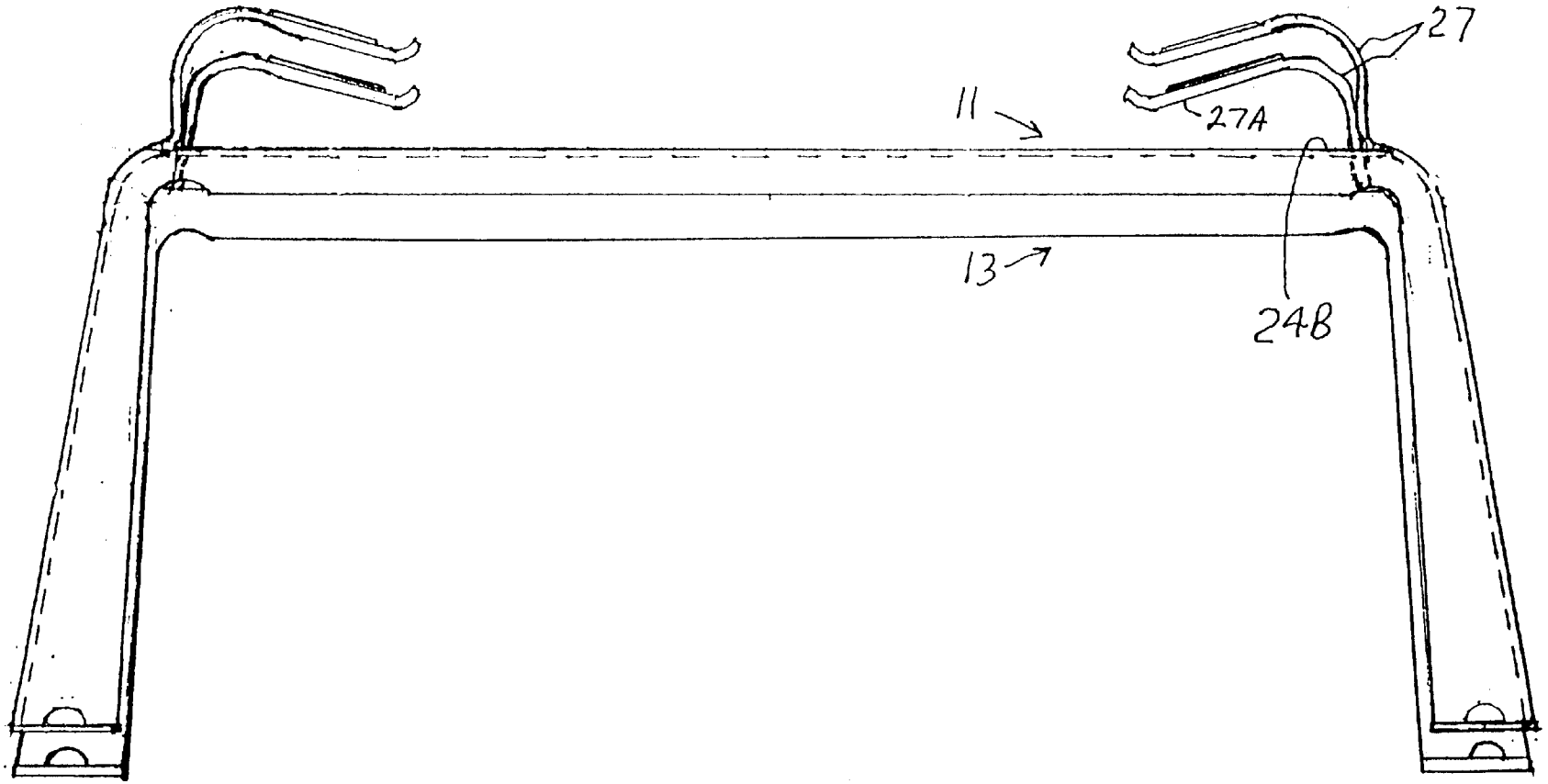
FIG. 10 shows a side elevational view a pair of rod chairs of FIG. 2 stacked for packaging and shipment.

FIG. 10 illustrates features of this invention wherein two rod chairs 11 and 13 are stacked for packaging and shipping. The hook 27A of the rod chair 13 projects freely upwardly through the three sided cut-out 24B of the rod chair 11. The three sided cut-out 24B has a width slightly greater than the width of the hook 27A to permit the hook 27A of the rod chair 13 positioned beneath the rod chair 11 to project freely through the cutout 24B to permit stacking of identical rod chairs.

Furthermore, the rod chairs in accord with this invention are fabricated so that the legs taper at an angle of about 10° as shown in FIGS. 3 and 4 to permit ready stacking. Even the flanges 23 may be enlarged, if necessary.

While the invention has been described with respect to certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the united states is:

1. A rod chair for positioning and supporting elongated reinforcement rods in concrete structure comprising an elongated body having a longitudinal axis and having a planar portion, said planar portion having a pair of spaced distal ends, said body including a pair of spaced generally curved end walls extending generally along said axis and integral with respective said distal end and a pair of generally vertical parallel flanges extending downwardly from said planar portion, at least one elongated finger formed integrally from said planar portion adjacent said end walls and extending upwardly above the plane of said planar portion adjacent said end walls and extending upwardly above the plane of said planar portion for holding a reinforcement rod therein, and a pair of elongated and spaced stabilizing leg portions integral with respective said end walls to support said planar portions spacedly above ground.

2. The rod chair of claim 1 wherein said planar portion includes a pair of slots from which said fingers are cut out, each of said slots having three free sides and respective said finger forming a fourth side of said slot, each of said slots having a width slightly greater than a width of said finger to permit stacking of said rod chair onto an identical rod chair.

3. The rod chair of claim 1 wherein said finger forms a hook having a curved portion with an inner surface and outer surface for sandwiching a reinforcement rod between said planar portion and said inner surface of said hook.

4. The rod chair of claim 3 wherein said hook further including a rib formed in said inner surface to rigidify said hook to enhance holding of a reinforcement rod therebeneath.

5. The rod chair of claim 1 wherein said planar portion further includes a pair of spaced indexing apertures for manufacturing guides, each said aperture being positioned spacedly from a central transverse axis of said elongated body.

6. The rod chair of claim 1 wherein each said stabilizing leg portion includes a pair of spaced oppositely disposed legs each having a pair of planar faces perpendicular with each other, a respective elongated foot having a lower surface and being integral with at least one of said planar faces and extending transversely of said longitudinal axis to support said planar portion and a reinforcement rod thereon with said lower surface on ground.

7. The rod chair of claim 6 wherein said foot further including an elongated rib extending upwardly from said lower surface.

8. The rod chair of claim 6 wherein said each stabilizing leg portion further includes a recess disposed between said pair of spaced oppositely disposed legs to permit bifurcation and separation angularly of said leg portions into-said pair of legs.

9. The rod chair of claim 8 wherein said recess cut-out includes a lip extending downwardly.

10. The rod chair of claim 1 further including another finger formed integrally with said end walls and extending upwardly above the plane of said planar portion for holding a respective reinforcement rod therein.

11. The rod chair of claim 1 further including a pair of fingers formed integrally from said planar portion and extending upwardly above the plane of said planar portion for holding respective reinforcement rod therein, and wherein at least said one finger being adjacent said end walls.

12. The rod chair of claim 1 wherein said at least one finger includes a pair of angularly spaced smaller fingers extending away from each other and bent around a reinforcement rod to hold said rod therebetween.

13. A rod chair for positioning and supporting elongated reinforcement rods in concrete structure comprising an elongated body having a longitudinal axis and having a planar portion, said planar portion having a pair of spaced distal ends, said body including a pair of spaced generally curved end walls extending generally along said axis and integral with said distal end and a pair of generally vertical parallel flanges extending downwardly from said planar portion, a pair of elongated fingers formed integrally from said planar portion adjacent said end walls and extending upwardly above the plane of said planar portion for holding a respective reinforcement rod therein, and a pair of elongated and spaced stabilizing leg portions integral with respective said end walls to support said planar portion spacedly above ground, each said stabilizing leg portion includes a pair of spaced oppositely disposed legs each having a pair of planar faces perpendicular with each other, a respective elongated foot having a lower surface and being integral with at least one of said planar faces and extending transversely of said longitudinal axis to support said planar portion and reinforcement rod thereon with said lower surface on ground.

14. The rod chair of claim 13 wherein said foot further including an elongated rib extending upwardly from said lower surface.

15. The rod chair of claim 13 wherein said each stabilizing leg portion further includes a recess cut-out disposed between said pair of spaced oppositely disposed legs to permit bifurcation and separation angularly of said leg portions into said pair of legs.

16. The rod chair of claim 15 wherein said recess cut-out includes a lip extending downwardly.

17. The rod chair of claim 13 wherein said planar portion includes a pair of slots from which said fingers are cut out, each of said slots having three free sides and respective said finger forming a fourth side of said slot, each of said slots having a width slightly greater than a width of said finger to permit stacking of said rod chair onto an identical rod chair.

18. The rod chair of claim 13 wherein said finger forms a hook having a curved portion with an inner surface and outer surface for sandwiching a reinforcement rod between said planar portion and said inner surface of said hook.

19. A flat rectangular metal blank having free ends and a longitudinal axis therebetween and central transverse axis for folding into a rod chair comprising an elongate planar portion, having a pair of spaced distal ends and having a pair of portions spaced from respective said free ends to be bent to form a pair of spaced generally curved end walls extending generally along said axis and integral with respective said distal end and a pair of vertical parallel sides to be bent downwardly to form a pair of parallel generally horizontal flanges, said planar portion having at least one three-sided cut-out forming at least one elongated finger integrally with its free end to be bent upwardly to form a hook for sandwiching a reinforcement rod between said hook and said planar portion, a pair of recess cut-outs from said planar portion remotely from respective said free ends of said planar portion, and elongated cuts intersecting respective said recess cut-outs and extending generally along said longitudinal axis to respective said free ends of said metal blank to form a pair of stabilizing leg portions to support said planar portion above ground.

20. The metal blank of claim 19 wherein each said recess cut-out includes a lip extending downwardly in said blank and disposed generally medially of said leg portion to permit bifurcation and separation angularly of said leg portion into a pair of spaced oppositely disposed legs.

21. The metal blank of claim 20 wherein each said leg having a lower portion and an upper portion, said upper portion being bent to form a face generally continuous with said horizontal flanges, and another face generally transverse to said longitudinal axis.

22. The metal blank of claim 21 wherein said lower portion of said each leg is bent to form a foot extending in a direction generally transversely of said longitudinal axis.

23. The metal blank of claim 22 wherein each said foot includes a rib extending upwardly and generally transversely of said longitudinal axis, said at least one elongated finger having a rib extending upwardly and generally parallel to said longitudinal axis.

* * * * *